US007156763B1

(12) United States Patent
Liao

(10) Patent No.: US 7,156,763 B1
(45) Date of Patent: Jan. 2, 2007

(54) PING PONG TABLE WITH FOLDING PROTECTION MECHANISM

(76) Inventor: Grace Liao, 9F, No. 196, Ming-Sheng Rd, Hsinchu City (TW)

( * ) Notice: Subject to any disclaimer, the term of this patent is extended or adjusted under 35 U.S.C. 154(b) by 0 days.

(21) Appl. No.: 11/223,590

(22) Filed: Sep. 9, 2005

(51) Int. Cl.
*A63B 67/04* (2006.01)

(52) U.S. Cl. ..... 473/496

(58) Field of Classification Search ..... 473/496; 108/162, 167, 115
See application file for complete search history.

(56) References Cited

U.S. PATENT DOCUMENTS 3,777,674 A * 12/1973 Parsons ..... 108/175
3,916,258 A * 10/1975 Westrom ..... 361/41
5,020,799 A * 6/1991 Chang ..... 473/15
6,120,397 A * 9/2000 Julian ..... 473/496
6,425,835 B1 * 7/2002 Kettler ..... 473/496
2004/0266568 A1 * 12/2004 Dadbeh ..... 473/496

* cited by examiner

*Primary Examiner*—Raleigh W. Chiu

(57) ABSTRACT

A ping pong table with folding protection mechanism is disclosed. At least a pair of folding protection mechanisms is installed underneath the table, one on each side. Each folding protection mechanism is composed of at least one guide roller, one steel cable, and one pneumatic cylinder. The two halves of the ping pong table are folded and supported by an under carriage that is pivotally attached onto the underside of the table. The pneumatic cylinder on each side has one end connected to a cross bar under the table, and the other end connected to a steel cable, which then, through guide rollers, is further connected to the bottom beam of the undercarriage. This folding protection mechanism makes the folding/unfolding of the ping pong table easier and more user-friendly, so even one person is able to handle the table set up without difficulty.

6 Claims, 6 Drawing Sheets

PING PONG TABLE WITH FOLDING PROTECTION MECHANISM

BACKGROUND OF THE INVENTION

1. Field of the Invention

The present invention relates to a ping pong table that utilizes a pneumatic folding mechanism to make the folding/unfolding of a ping pong table easier and more user friendly.

2. The Related Art

The folding ping pong tables are mostly used indoors to save space, but this sports table could also be put in an outdoor environment. The two halves of the table or drop leaves are folded up in standing position when not in play and supported by an undercarriage that has multiple casters on the bottom, so the ping pong table can be rolled away for storage.

The conventional ping pong tables are constructed with linking bars, folding pieces, and two half tables (drop leaves). The two half tables are folded and placed in upright position when not in play. However, as these sports tables usually do not have the safety mechanisms, so the users could be accidentally hurt by the folding pieces when assembling the table. For example, an unlocked drop leaf may fall down and hit the person below, or a person's fingers could be badly squeezed between two folding pieces. Therefore, as a safety precaution, there shall be two persons to handle the set up of the ping pong table.

Now, there is an innovative ping pong table that employs a pneumatic apparatus underneath the table to dampen the motion of the folding pieces, so that even one person is able to handle the set up of the ping pong table without much difficulty.

In these aspects, the folding protection mechanism according to the present invention substantially reduces or obviates the limitations and disadvantages of the prior art.

SUMMARY OF THE INVENTION

The primary object of the invention is to provide a ping pong table with folding protection mechanism that has at least one pair of pneumatic apparatuses installed underneath the table to dampen the motion of the folding pieces when folding or unfolding the table, so as to enhance the operational safety for the person setting up the table.

The second object of the invention is to provide a ping pong table with folding protection mechanism that enables one person to handle the set up of the table without difficulty.

The third object of the invention is to provide a ping pong table with high safety mechanism that can be designed with a simple structure and low cost for economical production.

To attain the above-mentioned objects, the folding protection mechanism for ping pong table is composed of at least a pair of guide rollers, a pair of steel cables, and a pair of pneumatic cylinders. The folding protection mechanism on each side is installed underneath the table below the center line. One end of the steel cable is connected to the bottom beam of the undercarriage, and the other end through the guide rollers to the pneumatic cylinder fixed underneath the table.

The two halves, or drop leaves, of the ping pong table are folded up when not in play, and supported by an undercarriage that is pivotally attached onto the underside of the table in transversal orientation.

These along with other features of novelty which characterize the invention, are pointed out with particularity in the claims annexed to and forming a part of this disclosure.

For a better understanding of the invention, the operating advantages and the specific objectives attained by its uses, references should be made to the accompanying drawings and descriptive matter illustrated in preferred embodiments of the invention.

DETAILED DESCRIPTION OF THE PREFERRED EMBODIMENT

Figure 1:
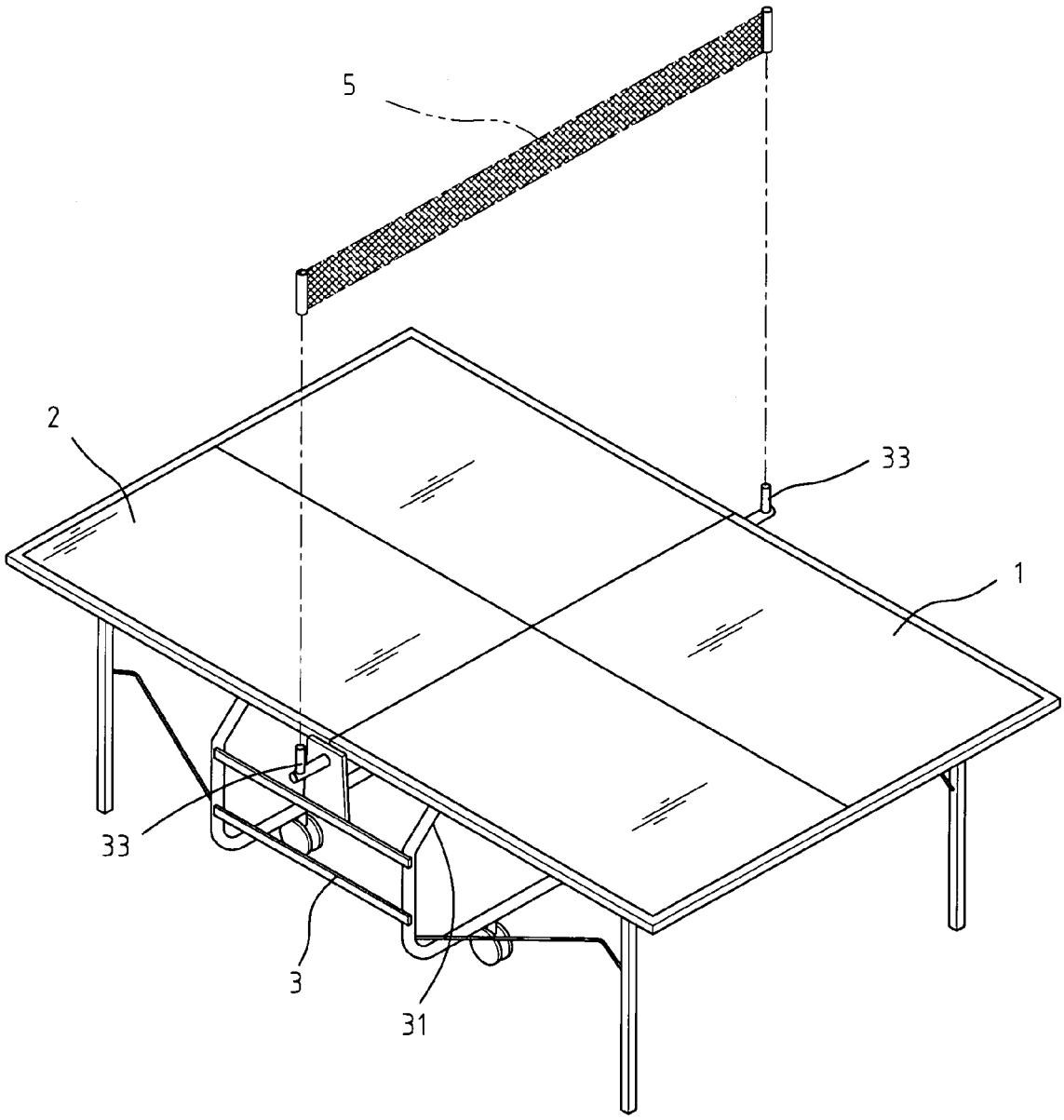
FIG. 1 is a perspective view of the present invention.
Figure 2:
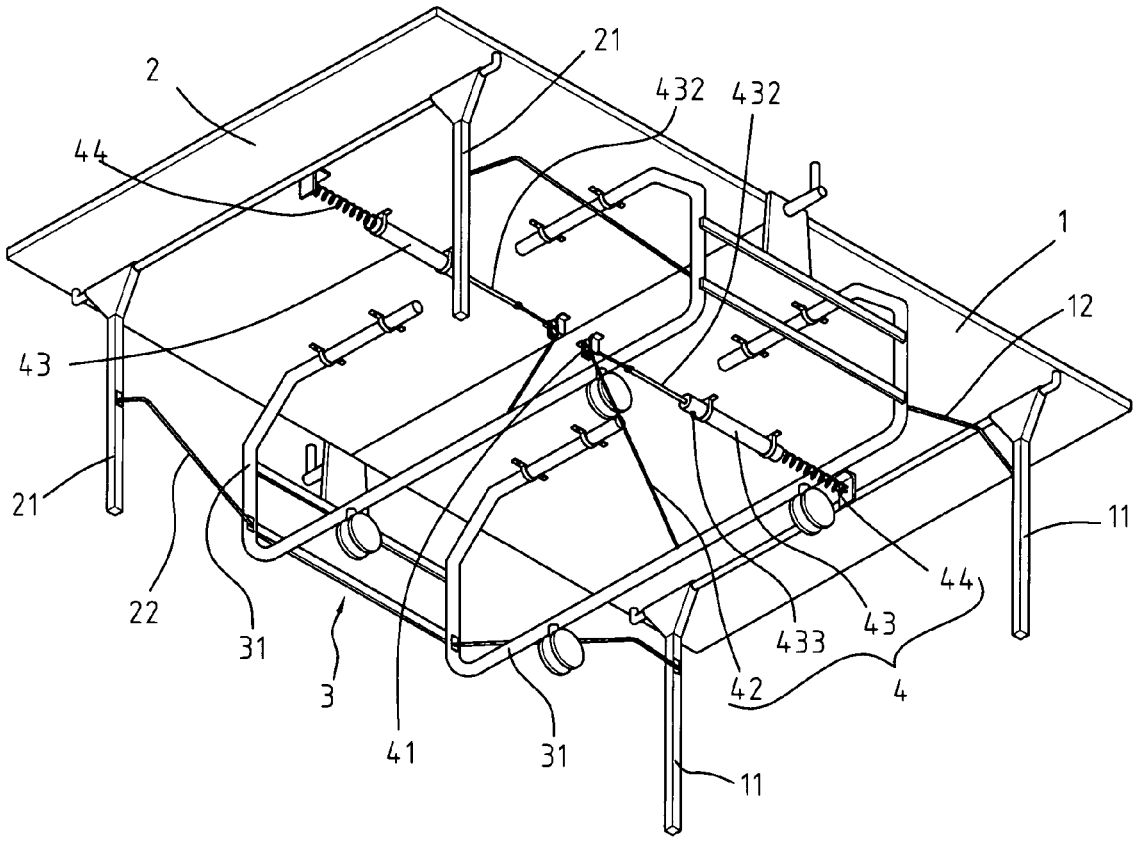
FIG. 2 is a bottom view of the folding protection mechanism being installed longitudinally underneath the table.

Referring to FIGS. 1, 2, the two halves 1, 2 (drop leaves) of the ping pong table are folded and supported by an under carriage 3 that has two vertical support frames 31 pivotally attached onto the underside of the table. The folding protection mechanism 4 is composed of at least a pair of guide rollers 41, a pair of steel cables 42, and a pair of pneumatic cylinders 43. The folding protection mechanism 4 is installed underneath the table on each side. One end of the steel cable 42 is connected to the bottom beam of the vertical support frame 31 on each side, and the other end through the guide rollers 41 is connected to the pneumatic cylinder 43.

Figure 3:
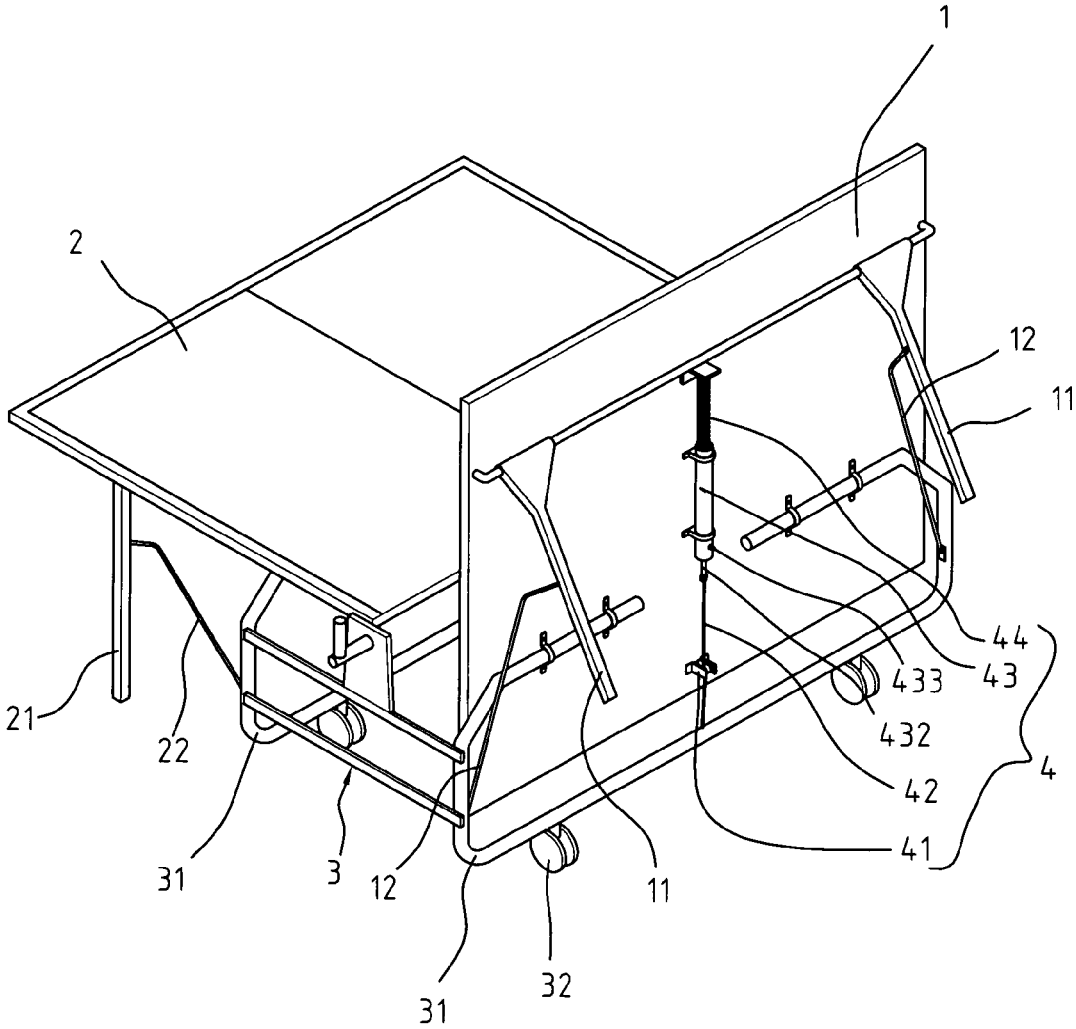
FIG. 3 is a diagram of the ping pong table half folded, showing the folding protection mechanism and other folding pieces on the underside of the table.

When the table is not in play, the two halves 1, 2 of the table are folded up through the action of the two pivotal beams of each vertical support frame 31 of the undercarriage 3, which are attached on the backside of the table top as shown in FIG. 3. The motion of the folding half table ½ is stopped when the half table ½ is turned to the upright *position*, so that the lower section of the half table ½ is reclined against the broadside of the vertical support frame 31 to prevent *tilting*.

The focus of the present invention is on the folding protection mechanism 4. The folding protection mechanism 4 is installed longitudinally below the center line on each side of the table, having one end fixed on a cross bar under the table, and the other end linked to the bottom beam of the vertical support frame 31. The folding protection mechanism 4 could either use a single-action pneumatic apparatus or a double-action pneumatic apparatus, where the piston of a single-action apparatus as in the preferred embodiment is returned by a spring.

Figure 4:
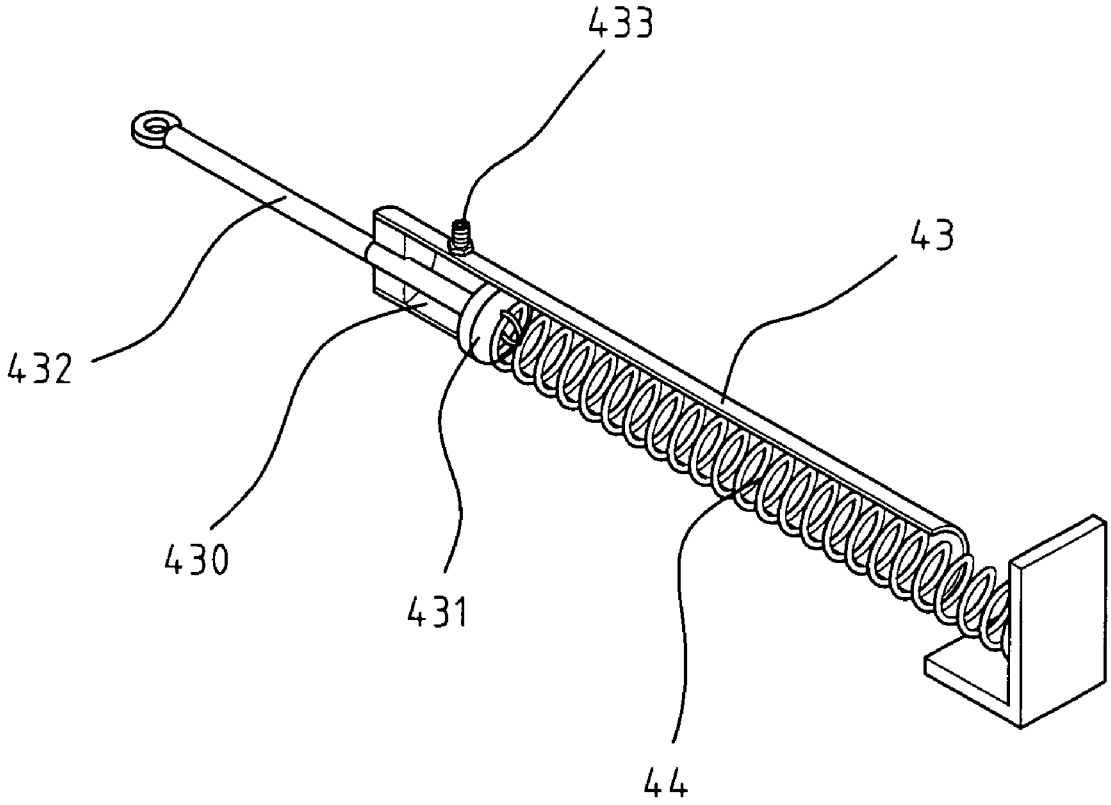
FIG. 4 is a sectional view of the internal structure of a pneumatic apparatus.

Referring to FIG. 4, the pneumatic cylinder 43 is formed by a piston 431, a cylinder rod 432, and a check valve 433, where one section of the cylinder rod 432 is inside the cylinder 43 with a cavity 430, while another end extends axially through a hole to the outside to be connected to the steel cable 42 near the guide roller 41. The check valve 433 is disposed on the side wall of the pneumatic cylinder 43 for controlling the air flow. The pneumatic cylinder 43 also has an open mouth on the opposite end of the center hole for holding a spring 44, of which one end is connected to the bottom of the piston 431, and another end is fixed to the cross beam under the table.

The guide rollers 41 are disposed along the path of the given path of the cable 42 that is below the center line of the table, so that the steel cable 42 starts from the middle of the bottom beam of the vertical support frame 31, and then after taking one or more turns through the guide rollers 41 is linked to the cylinder rod 432 of the pneumatic cylinder 43. The guide roller 41 is used to change the direction of the cable 42, so that the upper section of the cable 42 is able to run parallel to the underside table surface before connecting to the pneumatic cylinder 43. The action of the pneumatic cylinder 43 can effectively dampen the motion of the folding pieces to prevent bodily injury on a person who is assembling the table.

Referring to FIGS. 2, 3, to have the half table 1 folded, a horizontally oriented half table 1 is slightly pushed up along the outer edge, so the half table 1 starts to fold up slowly, aided by the return of the spring 44. The motion of the folding half table 1 will proceed at a steady pace until the lower section of the half table 1 is blocked alongside the vertical support frame 31 of the undercarriage 3. In the process, the pneumatic cylinder 43 is to dampen the motion through the action of the piston 432 and spring 44, as air flows into the pneumatic cylinder 43 through the check valve 433. The other half table 2 is to be folded in like manner. If not for the folding protection mechanism 4, the motion of the folding half table 1 will tend to accelerate once the action is started. The person handling the ping pong table could be hurt by the folding pieces.

Referring to FIGS. 2, 3, to have the half table 1 unfolded, a vertically oriented half table 1 is pulled down and out along the outer edge. The cylinder rod 432 is pulled out, compressing the air in the pneumatic cylinder 43 and stretching the spring 44 on the other end of the pneumatic cylinder 43. Since the tension on the cable 41 is steadily increased, the motion of the unfolding half table will be slowed down. The unfolding of the half table 1 will proceed until the half table is laid flat and supported by the two legs in standing position. The other half table 2 is to be unfolded in like manner. If not for the folding protection mechanism 4, the motion of the unfolding half table will tend to accelerate once the action is started. The person handling the ping pong table could be hurt by the folding pieces. The folding protection mechanism 4 allows the set up of the ping pong table to proceed in much safer conditions with less risk of body injuries.

The type of pivotal joint to be applied on the ping pong table may vary, depending on the structural design of the folding table. The number of roller casters at the bottom of the undercarriage 3 can also be changed.

Again referring to FIGS. 1, 2, according to the first preferred embodiment, the ping pong table is accompanied by a meshed net 5 and a net support 33 dividing the table top into two equal halves 1, 2 with a center line running across the table top lengthwise.

A pair of folding legs 11, 21 are installed, on the underside, near the outside corners of each half table 1,2, which are connected by two linking bars 12, 22 to the vertical support frames 31 on each side to balance the forces on all sides of the rectangular table. When the table is folded, the legs 11, 21 and linking bars 12, 22 are all folded up lying against the back side of the table as shown in FIG. 3.

Figure 5:
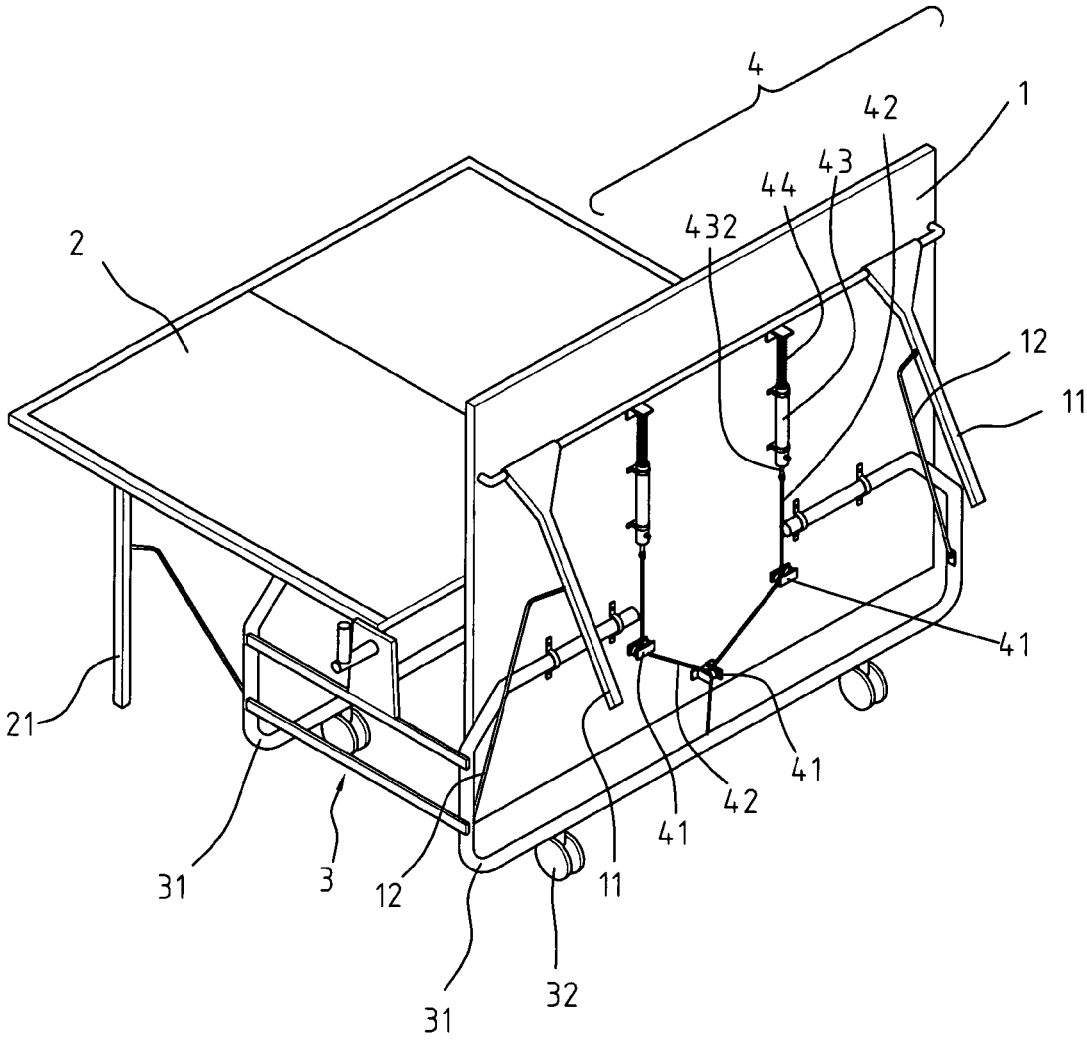
FIG. 5 is a diagram of the second embodiment of the invention using two pneumatic cylinders in parallel arrangement.

Referring to FIG. 5, the folding protection mechanism 4 in the second embodiment employs two pneumatic cylinders being arranged in parallel, multiple guide rollers 41 and multiple steel cables 42. This design is intended to balance the force with two smaller pneumatic cylinders 43 and possibly further increase the damping effect.

Figure 6:
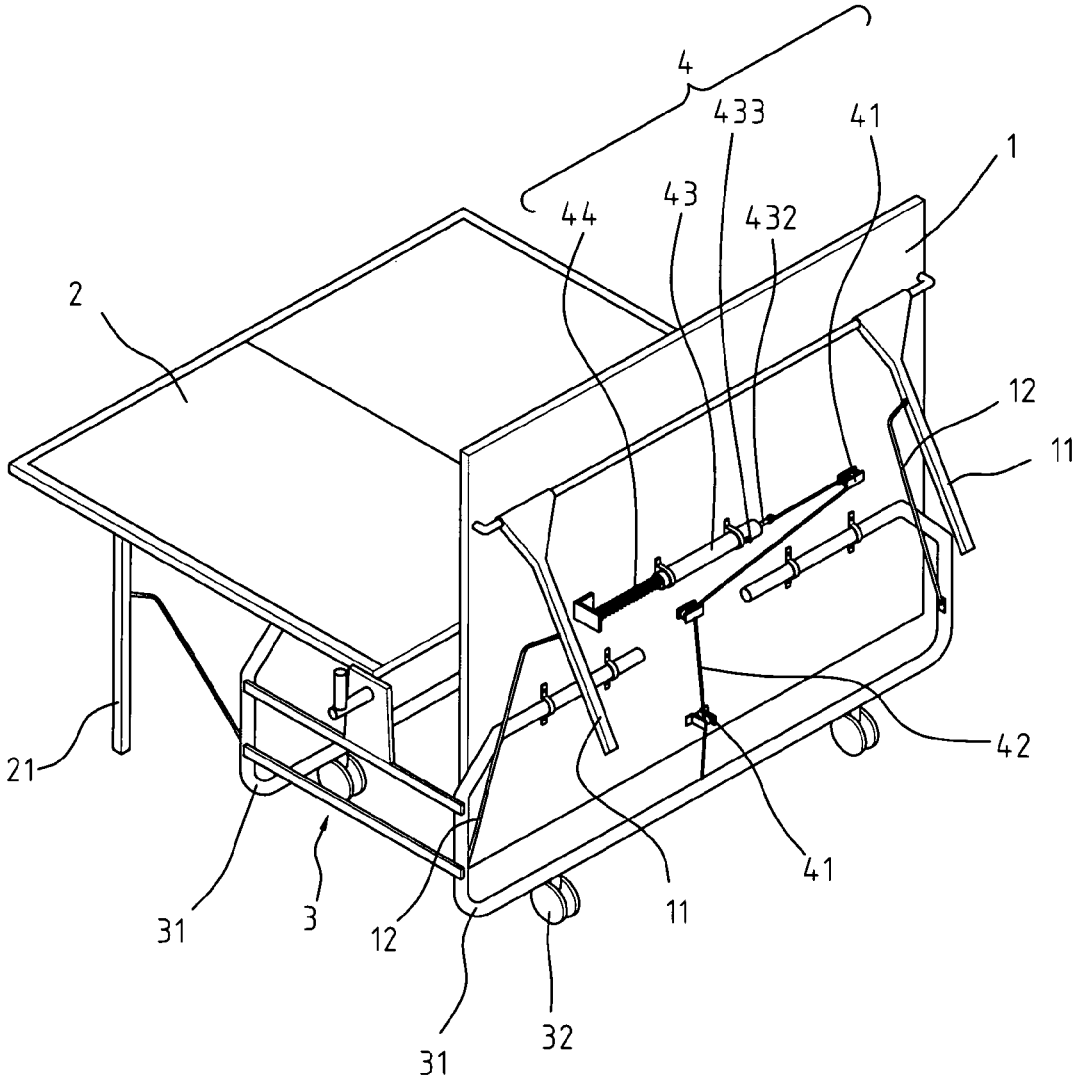
FIG. 6 is a diagram of the third embodiment of the invention using a pneumatic cylinder installed transversally and linking to the cable with two intermediate turns.

Referring to FIG. 6, the folding protection mechanism 4 in the third embodiment uses one pneumatic cylinder being disposed in the transversal direction, perpendicular to those used previously, so the path of the linking cable 42 to the pneumatic cylinder 43 requires one or two extra turns using one or more guide rollers 41. This is to further slow down the motion of the folding half table. Also, this can rationalize the use of space on the underside of the table, and prevent tangling of the cables and other objects under the table.

Although the present invention has been described with reference to the preferred embodiments thereof, it is apparent to those skilled in the art that a variety of modifications and changes may be made with regard to different forms and shapes without departing from the spirit and scope of the present invention which is intended to be defined by the appended claims.

What is claimed is:

1. A ping pong table with folding protection mechanism, comprising:

two halves of a table;

an undercarriage including two vertical support frames that are pivotally attached onto the underside of each half table; and at least a pair of folding protection mechanisms installed on the underside, each of which is formed by one guide roller, a steel cable, and a pneumatic cylinder;

wherein the cable has one end connected to the pneumatic cylinder, and another end connected through multiple guide rollers to the middle of a bottom beam of the undercarriage and the folding protection mechanism is installed on the underside of each side, having one end connected to a cross beam under the table, and the other end connected to the steel cable, which then is further connected to the bottom beam of the undercarriage through the guide rollers.

2. The ping pong table as claimed in claim 1, wherein one end of the steel cable is connected to the bottom beam of a vertical support frame on each side, and another end is connected to a cylinder rod linking with the pneumatic cylinder.

3. The ping pong table as claimed in claim 1, wherein the pneumatic cylinder has a piston, a cylinder rod, and a check valve, where one section of the cylinder rod is concealed inside the cylinder with central cavity, while another end of the cylinder rod extends through a hole to the outside to be connected to the steel cable, where the check valve on the side wall is used to control the air flow.

4. The ping pong table as claimed in claim 1, wherein the pneumatic cylinder has an open mouth end for attaching a spring, one end of which is connected to the bottom of the piston, and another end is fixed underneath the table.

5. The ping pong table as claimed in claim 1, wherein the folding protection mechanism is formed by multiple sets of rollers, steel cables, and pneumatic cylinders being arranged in parallel, where each cable branches out to be connected to multiple pneumatic cylinders passing through multiple guide rollers, and another end of the cable is connected to the bottom beam of the undercarriage.

6. The ping pong table as claimed in claim 1, wherein the pneumatic cylinder is installed in transversal direction, having one end fixed underneath the table, and another end through multiple guide rollers connected to the bottom beam of the undercarriage.

* * * * *